US011199087B2

(12) United States Patent
Finke et al.

(10) Patent No.: US 11,199,087 B2
(45) Date of Patent: Dec. 14, 2021

(54) MODULE FOR HOUSING COMPONENTS ON A DOWNHOLE TOOL

(71) Applicant: HALLIBURTON ENERGY SERVICES, INC., Houston, TX (US)

(72) Inventors: Michael Dewayne Finke, Cypress, TX (US); Brian David Breaux, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/417,313

(22) Filed: May 20, 2019

(65) Prior Publication Data

US 2020/0370422 A1 Nov. 26, 2020

(51) Int. Cl.
*E21B 47/12* (2012.01)
*E21B 49/10* (2006.01)
*E21B 47/017* (2012.01)

(52) U.S. Cl.
CPC ..... *E21B 47/12* (2013.01); *E21B 47/017* (2020.05); *E21B 49/10* (2013.01)

(58) Field of Classification Search
CPC ..... E21B 47/12; E21B 47/017; E21B 49/10
See application file for complete search history.

(56) References Cited

U.S. PATENT DOCUMENTS 6,012,537 A * 1/2000 Rountree ..... E21B 47/20 175/40
6,134,892 A * 10/2000 Turner ..... H01L 35/00 62/3.2
7,357,886 B2 4/2008 Groth
7,364,007 B2 * 4/2008 Garcia-Osuna ..... E21B 47/01 181/108
8,922,988 B2 12/2014 Swett et al.
9,638,819 B2 5/2017 Wang et al.
9,879,520 B2 1/2018 Fanini et al.
10,012,036 B2 7/2018 Goodman et al.
2005/0150655 A1 * 7/2005 Duong ..... E21B 47/01 166/249
2006/0043635 A1 3/2006 Groth
(Continued)

FOREIGN PATENT DOCUMENTS

CN 202385411 U 8/2012
JP 4393702 B2 1/2010
(Continued)

OTHER PUBLICATIONS

English abstract of JP4393702; retrieved from www.espacenet.com; May 16, 2019.
(Continued)

*Primary Examiner* — David Carroll
(74) *Attorney, Agent, or Firm* — Polsinelli PC

(57) ABSTRACT

Aspects of the subject technology relate to a component module for a downhole tool. The component module can include a platform for components for use in the downhole tool, an enclosure covering the platform for components, wherein the enclosure is configured to fit within a pocket of the downhole tool, and an elastomer layer surrounding at least one portion of the enclosure and preventing the at least one portion of the enclosure from touching the pocket of the downhole tool.

20 Claims, 6 Drawing Sheets

(56) References Cited

U.S. PATENT DOCUMENTS

| | | | | |
|---|---|---|---|---|
| 2012/0055710 | A1* | 3/2012 | Herrera | E21B 47/01 175/41 |
| 2012/0323352 | A1 | 12/2012 | Groth | |
| 2012/0324993 | A1* | 12/2012 | Nakajima | G01V 1/186 73/152.47 |
| 2013/0235537 | A1* | 9/2013 | Swett | H05K 5/0213 361/752 |
| 2015/0275652 | A1* | 10/2015 | Fanini | E21B 47/017 166/381 |
| 2015/0330208 | A1* | 11/2015 | Haubold | E21B 36/001 166/380 |
| 2017/0275984 | A1 | 9/2017 | Wang et al. | |
| 2018/0179882 | A1 | 6/2018 | Treviranus et al. | |

FOREIGN PATENT DOCUMENTS

| | | | |
|---|---|---|---|
| WO | 2015094213 | A1 | 6/2015 |
| WO | 2015104590 | A1 | 7/2015 |
| WO | 2017147452 | A1 | 8/2017 |

OTHER PUBLICATIONS

English abstract of CN202385411; retrieved from www.espacenet.com; May 16, 2019.

International Search Report and Written Opinion for International application No. PCT/US2019/034457, dated Feb. 20, 2020, 10 pages.

* cited by examiner

MODULE FOR HOUSING COMPONENTS ON A DOWNHOLE TOOL

TECHNICAL FIELD

The present technology pertains to assemblies for housing components, and more particularly, to assemblies for use on a downhole tool in a drilling environment.

BACKGROUND

In the exploration and production of hydrocarbons, various downhole tools are frequently lowered into a borehole, such as drilling assemblies, measurement tools, and production devices. Such downhole tools often include a number of components such as electronic equipment, sensors, or other modules used for various purposes. For example, the components may be used for controlling the downhole tools, communicating with a surface location, and storage and analysis of monitored wellbore data. These components may include sensitive parts including, for example, sensors, printed circuit boards (PCBs), and electronics that are mounted to the PCBs. The downhole tools and/or components to be secured to the downhole tools are shipped to the field, handled, and installed for use in a wellbore. The downhole tool may experience harsh downhole environments including, for example, elevated temperatures and pressures, vibration, thermo-mechanical stresses, and thermal shock.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
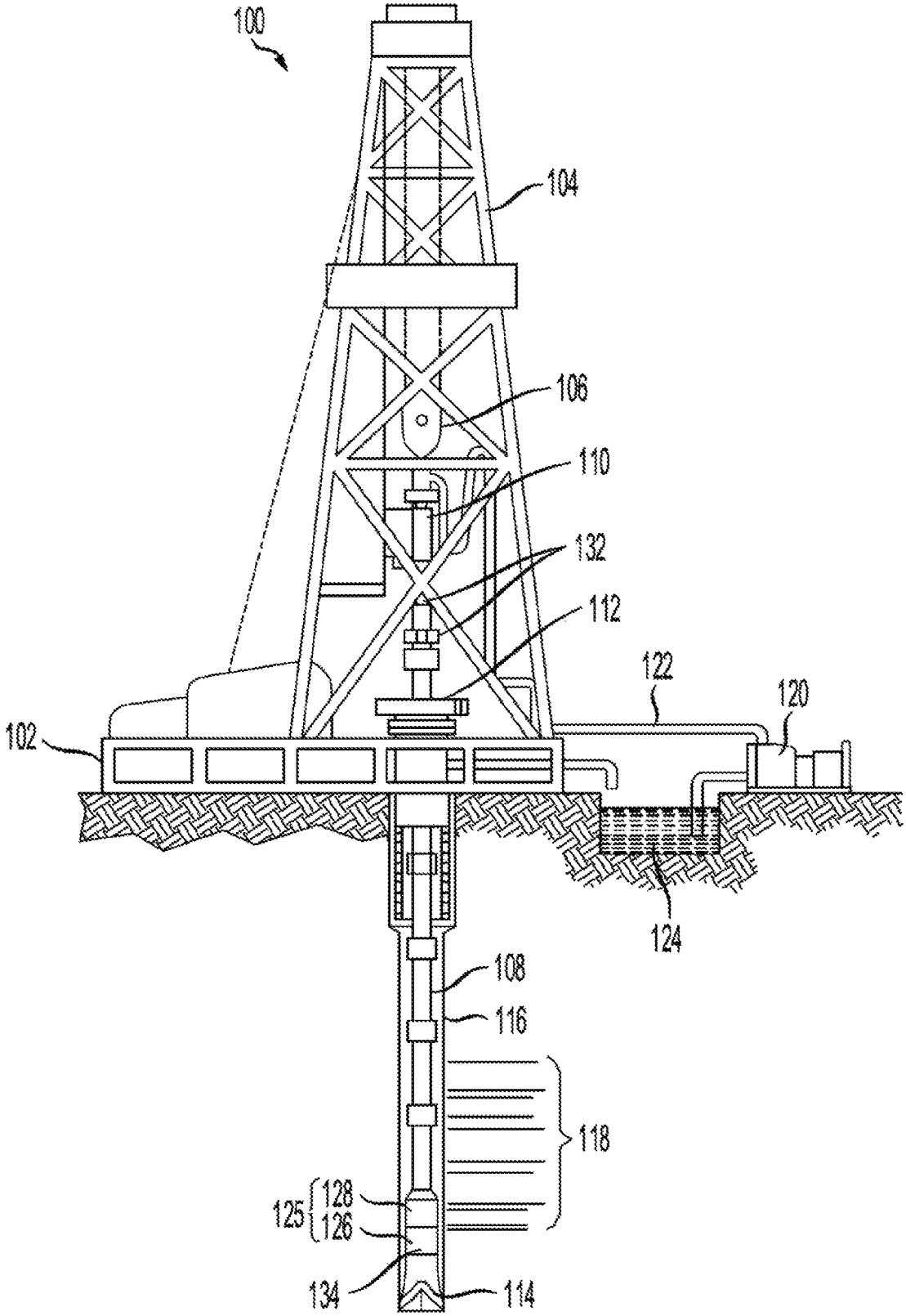
FIG. 1A is a schematic diagram of an example logging while drilling (LWD) wellbore operating environment, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Exploration and production of hydrocarbons generally involve the use of various tools that are lowered into or used to create a borehole, such as drilling assemblies, measurement tools, or production devices. Various components may be disposed downhole for various purposes, such as control of downhole tools, communication with the surface and storage and analysis of data. The components may include, for example, electronic components, sensors, power supplies, batteries and the like. Many of these components are sensitive or include sensitive parts. However, the downhole environments are quite harsh and may include extreme temperatures, pressures, vibrations, and/or other thermo-mechanical stresses. Even prior to being installed in a downhole tool for use, transporting the components and the downhole tool to remote field locations can involve difficult conditions that impose additional stresses.

Aspects of the subject technology relate to a component module for housing electronics and sensors on a downhole tool that protects the electronics and sensors from the harsh environments that may be experienced. Disclosed are systems, assemblies, and methods for housing electronics and sensors used on a downhole tool in a drilling environment. The component module may include a metal housing configured to fit within a pocket of a downhole tool. The metal housing may include a chassis portion and a cover portion. A circuit board may be positioned between the chassis portion and the cover portion of the metal housing. The circuit board may have one or more components (e.g., electronic components, sensors, power supplies, etc.) mounted to it. An elastomer sleeve may surround at least one portion of the metal housing and prevent that portion of the metal housing from making contact with other portions of the downhole tool.

These and other features of the component module solve various technical problems and provide various advantages over other approaches. For example, various aspects of the subject technology provide a highly reliable and affordable solution for protecting electronics and sensors in a downhole environment. The component module provides good vibration, shock isolation, and heat transfer characteristics while efficiently utilizing volumetric space within the downhole tool. The metal housing surrounds the circuit board and provides a rigid layer of protection for the circuit board and components mounted to the circuit board. The metal housing also minimizes undesired flexure of the electronics and sensors. An elastomer sleeve provides superior vibration transmissibility and shock isolation characteristics to protect the circuit board and components mounted thereupon. The metal housing also creates a cavity for the circuit board and has improved heat dissipation characteristics over other approaches. For example, another approach may include solid-molded assemblies where potting material is used to fill a cavity of an electronics module. The potting material may be a foam or silicon substance. However, components may generate heat and have a limited temperature range for peak performance and the potting material may have sub-optimal heat dissipation characteristics.

Furthermore, potting the components (e.g., electronics) in a solid-molded approach is subject to potential manufacturing and field maintenance problems. For example, after a significant investment in building and testing the electronic modules, they can become damaged beyond repair during the subsequent foaming/potting process. When the potting material is injected into a mold or cavity with the electronic components, for instance, it can move or damage components, wires, or connections. This also limits the variety of potting materials that may be used because, for example, high-pressure injection molding materials or processes can damage electronic components. Furthermore, when the potting material cures it can move wires and/or place stress on various electronic components of the circuit board, thereby increasing the failure rate of the circuit board. Additionally, in the high temperatures of the downhole environment, the potting materials may expand and damage the electronic components.

The solid-molding approach further involves expensive and time consuming injection molding and curing processes as compared to various aspects of the subject technology. Furthermore, once the potting material is cured around the electronic components, parts of the solid-molded module may not be reused or repaired. A feature of some aspects of the subject technology disclosed herein allow for the reuse of the metal housing and/or elastomer sleeve. The circuit board or components on the circuit board may also be reused, repaired, replaced, or swapped out with other components The disclosure now turns to FIG. 1A, which illustrates a schematic view of a logging while drilling (LWD) wellbore operating environment 100 in accordance with some examples of the present disclosure. As depicted in FIG. 1A, a drilling platform 102 can be equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, the drill bit 114 creates a wellbore 116 that passes through various subterranean formations 118. A pump 120 circulates drilling fluid through a supply pipe 122 to top drive 110, down through the interior of drill string 108 and orifices in drill bit 114, back to the surface via the annulus around drill string 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the drill bit 114 extends the wellbore 116 through the formations 118, logging tools 126 collect measurements relating to various formation properties as well as the orientation of the tool and various other drilling conditions. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled by one or more wires and/or other media. The logging tools 126 may also include one or more computing devices 134 communicatively coupled with one or more of the tool components by one or more wires and/or other media. The one or more computing devices 134 may be configured to control or monitor a performance of the tool, process logging data, and/or carry out one or more aspects of the methods and processes of the present disclosure.

In at least some instances, one or more of the logging tools 126 may communicate with a surface receiver 132 by a wire, such as wired drillpipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drillpipe.

Figure 1B:
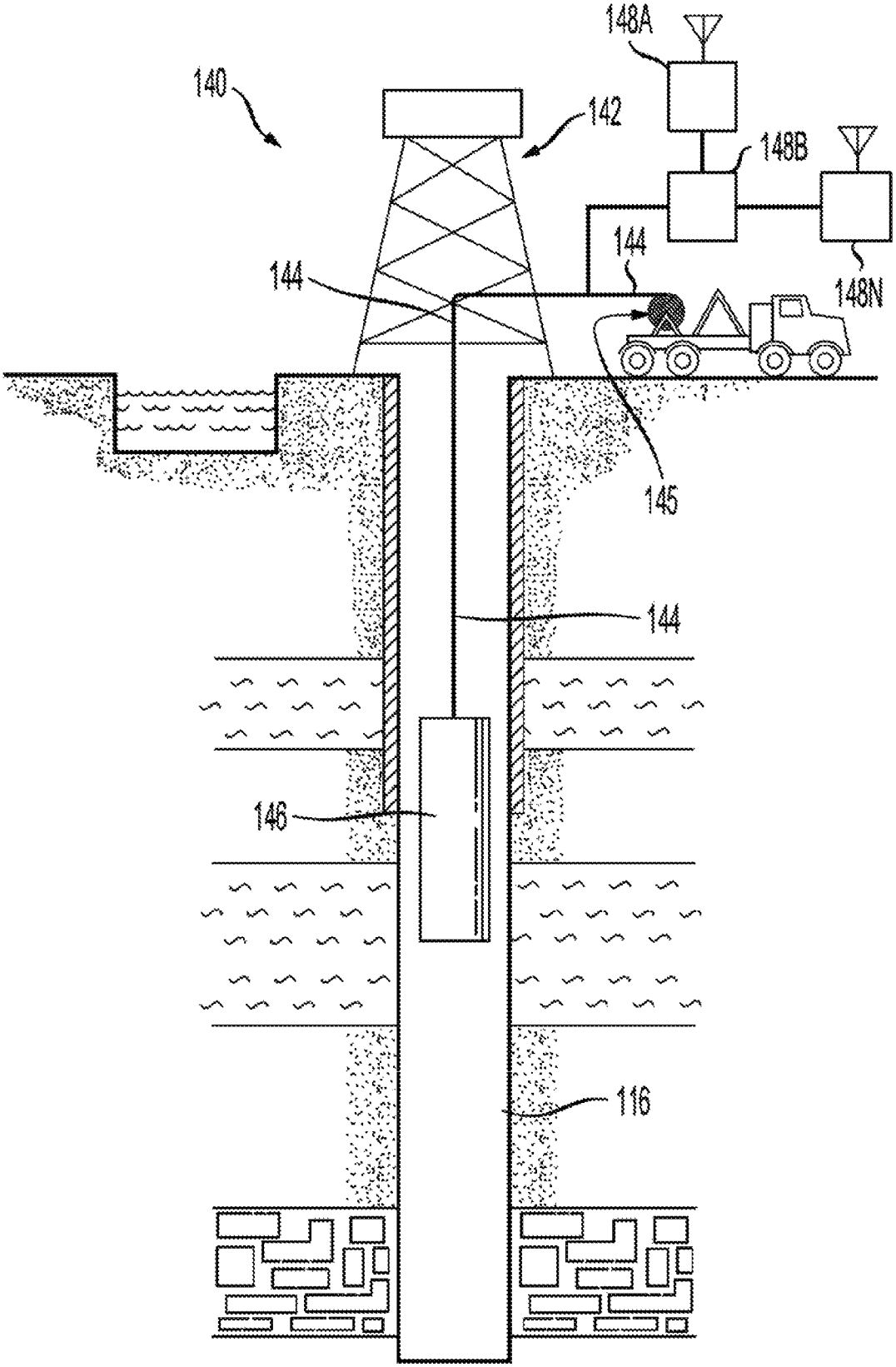
FIG. 1B is a schematic diagram of an example downhole environment having tubulars, in accordance with various aspects of the subject technology.

Referring to FIG. 1B, an example system 140 for downhole line detection in a downhole environment can employ a tool having a tool body 146 in order to carry out logging and/or other operations. For example, instead of using the drill string 108 of FIG. 1A to lower tool body 146 of FIG. 2 and which can contain sensors and/or other instrumentation for detecting and logging nearby characteristics and conditions of the wellbore 116 and surrounding formations, a wireline conveyance 144 can be used. The tool body 146 can include a resistivity logging tool. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars.

The illustrated wireline conveyance 144 provides power and support for the tool, as well as enabling communication between tool processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

Figure 2:
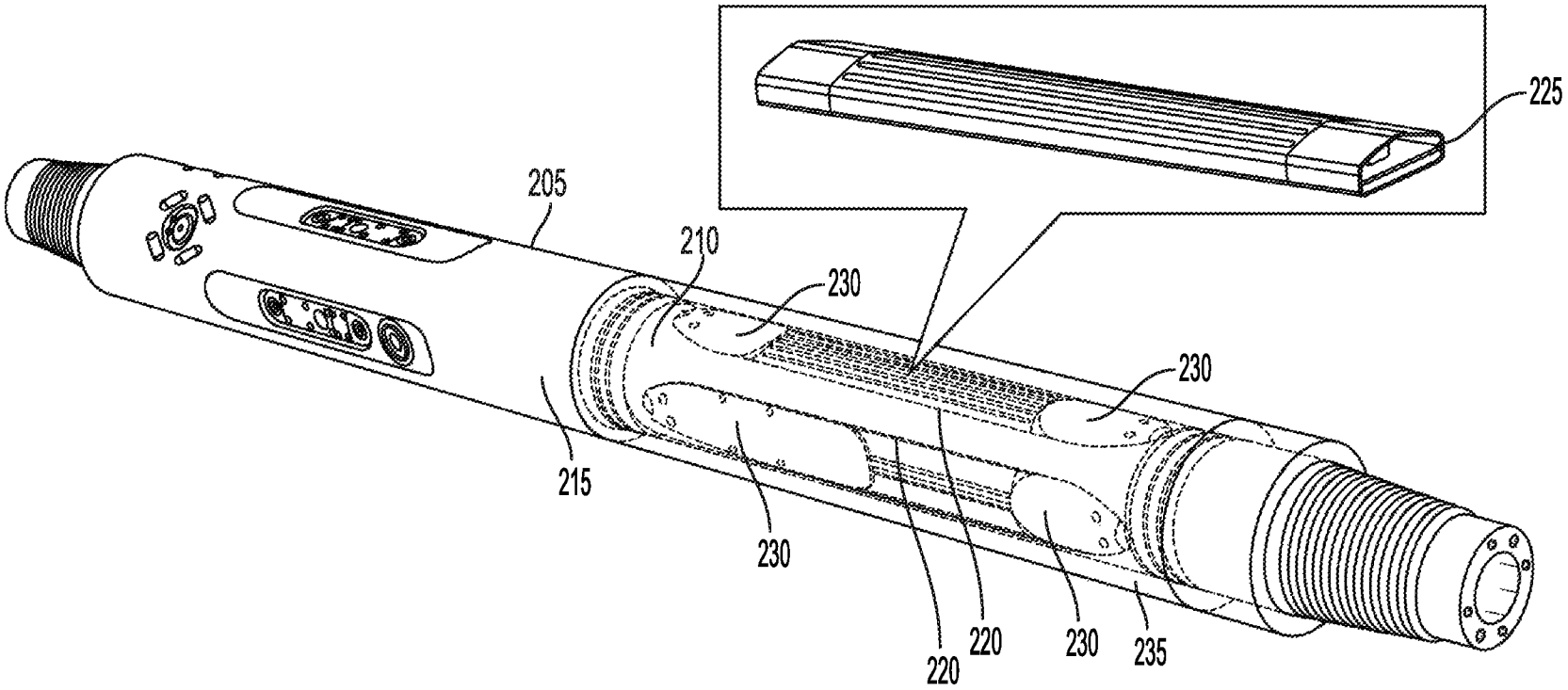
FIG. 2 is a schematic diagram of an example portion of a downhole tool, in accordance with various aspects of the subject technology.

FIG. 2 is a schematic diagram of an example segment of a downhole tool 205, configured in accordance with various aspects of the subject technology. The downhole tool may be, for example, the bottom-hole assembly 125 of FIG. 1A, the tool body 146 of FIG. 1B, or any other object lowered into a wellbore. The portion of the downhole tool may be or include one of the logging tools 126 of FIG. 1A, a sensor collar, an electronics collar, or any other portion of a downhole tool 205.

The segment of the downhole tool 205 shown in FIG. 2 includes a recessed portion 210 with a shorter diameter than an unrecessed portion 215 of the downhole tool 205. The recessed portion 210 of the downhole tool 205 includes one or more pockets 220 configured to receive component modules 225. Component module 225 shown in FIG. 2 is one example of a module for housing electronics and sensors, in accordance with various aspects of the subject technology.

The component module 225 may be held in place within a pocket 220 of the recessed portion 210 of the downhole tool 205 by one or more end tabs 230. As is illustrated in FIG. 2, the end tabs 230 may also be shaped to conform to the shape of the pocket 220 so that when secured in place, the top portion of the end tab 230 is substantially flush with the surface of the recessed portion 210 of the downhole tool 205. In other embodiments, other component modules 225 may be secured in place in pocket 220 using other means (e.g., screws, fasteners, clamps, tight fitting, etc.).

A pressure sleeve 235 or outer tube may surround the recessed portion 210 of the downhole tool 205 and any installed assemblies housing tool components. The pressure sleeve 235 may further secure the component modules (e.g., component module 225) in place within the pocket of the recessed portion 210 of the downhole tool 205 as well as provide additional protection to the component modules. In some variations, the pressure sleeve 235 may be configured such that the pressure sleeve 235 provides additional strength and stability to the downhole tool 205.

Although not shown in FIG. 2, in some aspects, an additional layer may be disposed between the pressure sleeve 235 and the recessed portion 210 of the downhole tool 205 and any installed component assemblies. The additional layer may be, for example, a sleeve made of fiberglass that reduces the friction between the pressure sleeve 235 and the recessed portion 210 of the downhole tool 205 and any installed component assemblies. The additional layer may ease in the installation of the pressure sleeve 235 and/or improve the functionality of the downhole tool 205 in operation.

Various aspects of the subject technology provide several technological improvements over other approaches and solve various technical issues seen in other approaches. For example, as noted above, the pressure sleeve 235 or outer tubing that covers the recessed portion 210 and component assemblies provide additional protection. In contrast, other approaches may involve mounting a PCB assembly directly into the outer portion of the downhole tool 205 that is open to the downhole environment. In some cases, a hatch cover may protect the PCB assembly. However, the PCB assembly and/or the hatch cover in these approaches lack the protection of the pressure sleeve 235 or outer tubing of FIG. 2 and also provide an object to catch on objects or protrusions in the wellbore, which may damage the PCB assembly, housed components, and/or the downhole tool. Furthermore, with these other approaches, permanent damage often results from the aggressive procedures required to remove the electronic modules for maintenance or replacement.

Figure 3:
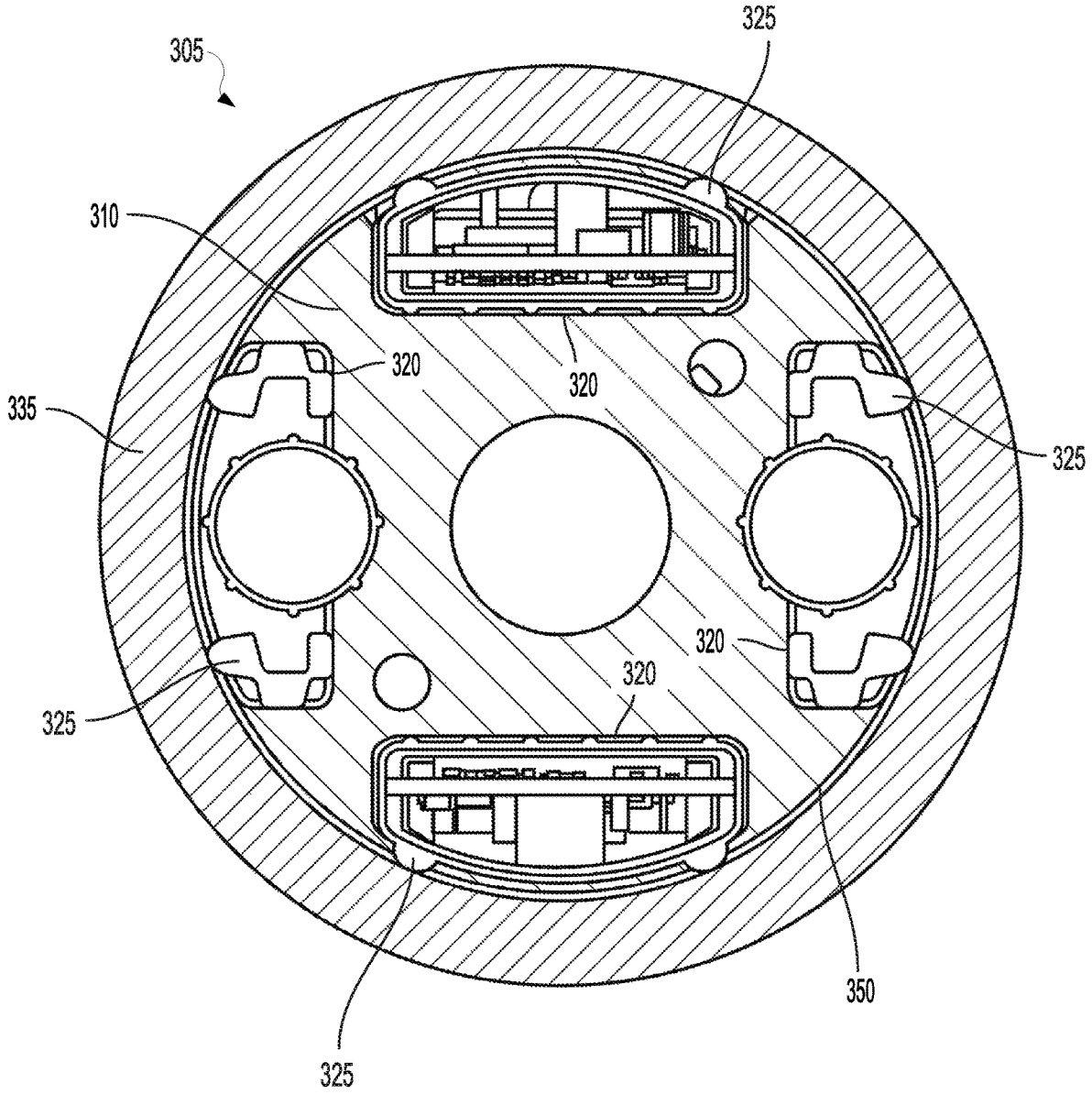
FIG. 3 is a schematic diagram of an example cross section of a downhole tool, in accordance with various aspects of the subject technology.

FIG. 3 is a schematic diagram of an example cross section of a downhole tool 305, in accordance with various aspects of the subject technology. The cross section illustrated in FIG. 3 is of a recessed portion 310 of the downhole tool 305 that includes 4 pockets 320 for component modules. The downhole tool 305 includes component modules 325 disposed within the pockets 320. The component modules 325 may contain components used on the downhole tool 305. For example, the components may include electronic equipment, sensors, transmitters, receivers, batteries, power supplies, computing devices or components (e.g., processors, memory, etc.), or the like. An outer tubing 335 or pressure sleeve surrounds the recessed portion of the downhole tool 305 and the component assemblies 325 and protects the downhole tool 305 and the component assemblies 325 from the downhole environment. In some aspects, an additional layer 350 may be disposed between the outer tubing 335 and the recessed portion 310 of the downhole tool 305 and any installed component assemblies. The additional layer 350 may be, for example, a sleeve made of fiberglass that reduces the friction between the outer tubing 335 and the recessed portion of the downhole tool 305 and any installed component modules. Additionally or alternatively, the additional layer 350 may provide an additional layer of protection or shock isolation.

Figure 4A:
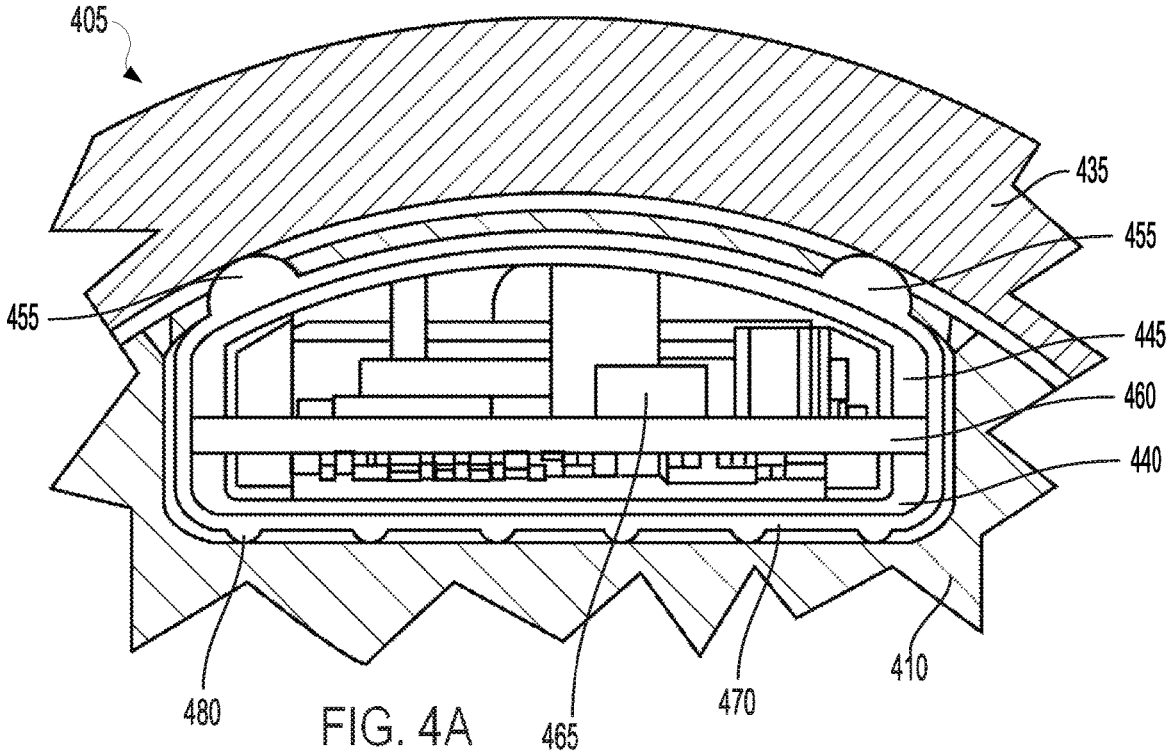
FIGS. 4A and 4B are schematic diagrams showing example cross sections of a component module, in accordance with various aspects of the subject technology.
Figure 4B:
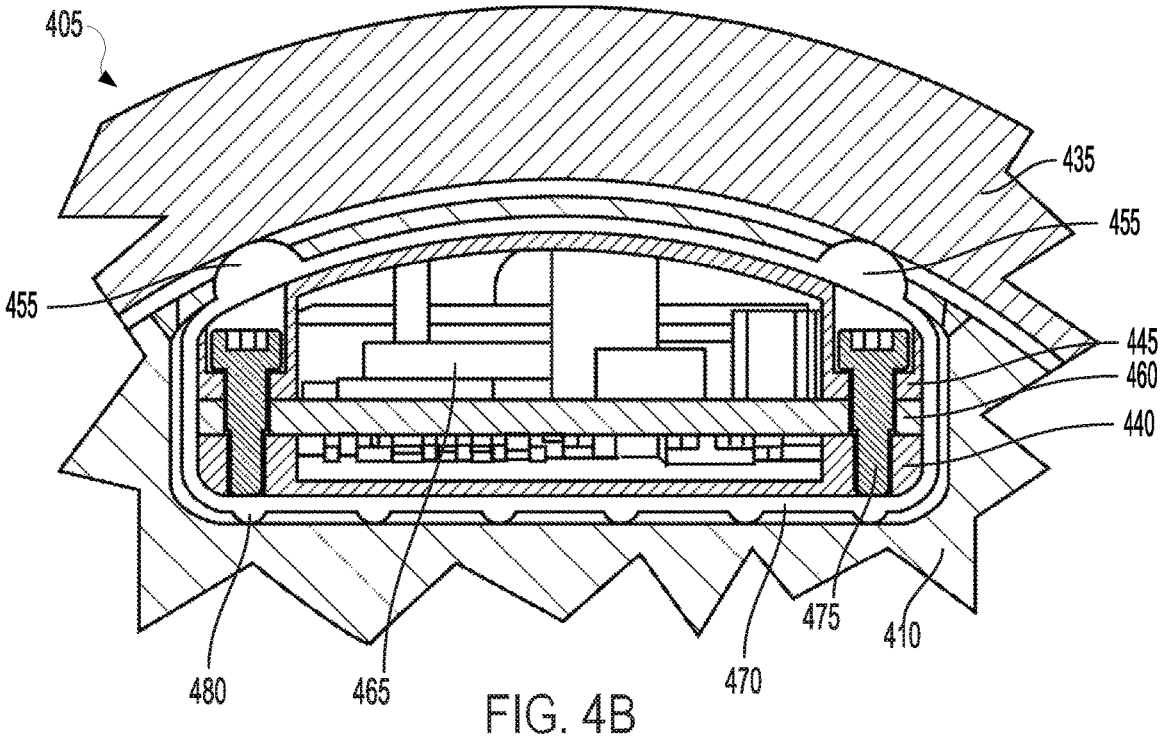

FIGS. 4A and 4B are schematic diagrams showing example cross sections of a component module, in accordance with various aspects of the subject technology. The component module is shown fitted within a pocket of a recessed portion 410 of a downhole tool 405. The component module of FIGS. 4A and 4B includes a housing made of a chassis portion 440 and a cover portion 445. The chassis portion 440 and/or the cover portion 445 may be made of metal and/or alloy such as aluminum or steel. The housing may surround one or more components to be used on the downhole tool 405. Some components may include electronics 465 that are mounted to a top side or a bottom side of a circuit board 460 (e.g., a PCB). The circuit board 460 may be mounted to the chassis portion 440 of the housing and covered by the covered portion 445 of the housing. Although there are several different methods of securing the circuit board 460 between the chassis portion 440 and the covered portion 445 of the housing, FIG. 4B shows the circuit board 460 mounted using retention screws 475 that may be placed through the covered portion 445 of the housing, through the circuit board 460, and into the chassis portion 440. According to some embodiments, the cavity formed by the chassis portion 440 and the cover portion 445 may be large enough to house multiple circuit boards in a stacked configuration.

One or more layers may form a sleeve 470 that surrounds at least a portion of the metal housing. The layer may be made of a polymer having elastic properties (e.g., an elastomer) or other rubberized material. The sleeve 470 may prevent the portion of the metal housing that is covered from coming in contact with the pocket of the downhole tool. The sleeve 470 may provide the metal housing with shock isolation as well as superior vibration transmissibility response. An outer tubing 435 or pressure sleeve covers the recessed portion 410 of the downhole tool 405 and the metal housing protects them from the downhole environment.

According to some implementations, the sleeve may include one or more raised surfaces 480 and 455 configured to optimize the shock isolation and/or vibration transmissibility characteristics of the sleeve 470 for use on the metal housing. The raised surfaces 480 and 455 may also be configured to aid the insertion of the metal housing into the pocket of the downhole tool 405 and/or the removal of the metal housing from the pocket. The raised surfaces 480 and 455 on the sleeve 470 may be made of the same material (e.g., an elastomer material) as the sleeve portion or of a different material depending on the desired characteristics. The raised surfaces 480 and 455 may also be in an orientation that provides for vertical ribs, horizontal ribs, nodes, nubs, bumps, or other configurations along the top, bottom, or sides of the metal housing.

According to some implementations, the raised portions may be configured to fit the metal housing into different pocket sizes, downhole tool sizes, and/or pipe sizes. For example, depending on the diameter of the downhole tool or the size of the pocket on the downhole tool, different sleeves may be selected and used on a metal housing. Accordingly, the same metal housing may be compatible with and reused across several different sizes and types of downhole tools simply by using different sleeves. This allows for the reuse of components and parts which reduces the cost involved with hydrocarbon exploration and production.

Depending on the preferred implementation, geometries of the surrounding elastomer can be changed to accommodate different surrounding pipe diameters (e.g., mouse ears, vertical ribs, horizontal ribs, etc.). For example, FIGS. 4A and 4B show the elastomer sleeve 470 with two raised surfaces 455 on opposite ends of the top portion of the elastomer sleeve 470. The two raised surfaces 455 look like "mouse ears" and may represent one or more bumps or ribs along the top portion of the elastomer sleeve 470 that run the length of the elastomer sleeve 470. The raised surfaces 455 allow for the elastomer sleeve to come in contact with the outer tubing 435 or pressure sleeve that surrounds the downhole tool 405 so that the sleeve 430 may provide the metal housing with shock isolation as well as superior vibration transmissibility response. On a different size downhole tool 405 and/or outer tubing 435, the raised surfaces may be larger, smaller, or removed in order to operate similarly.

Figure 5:
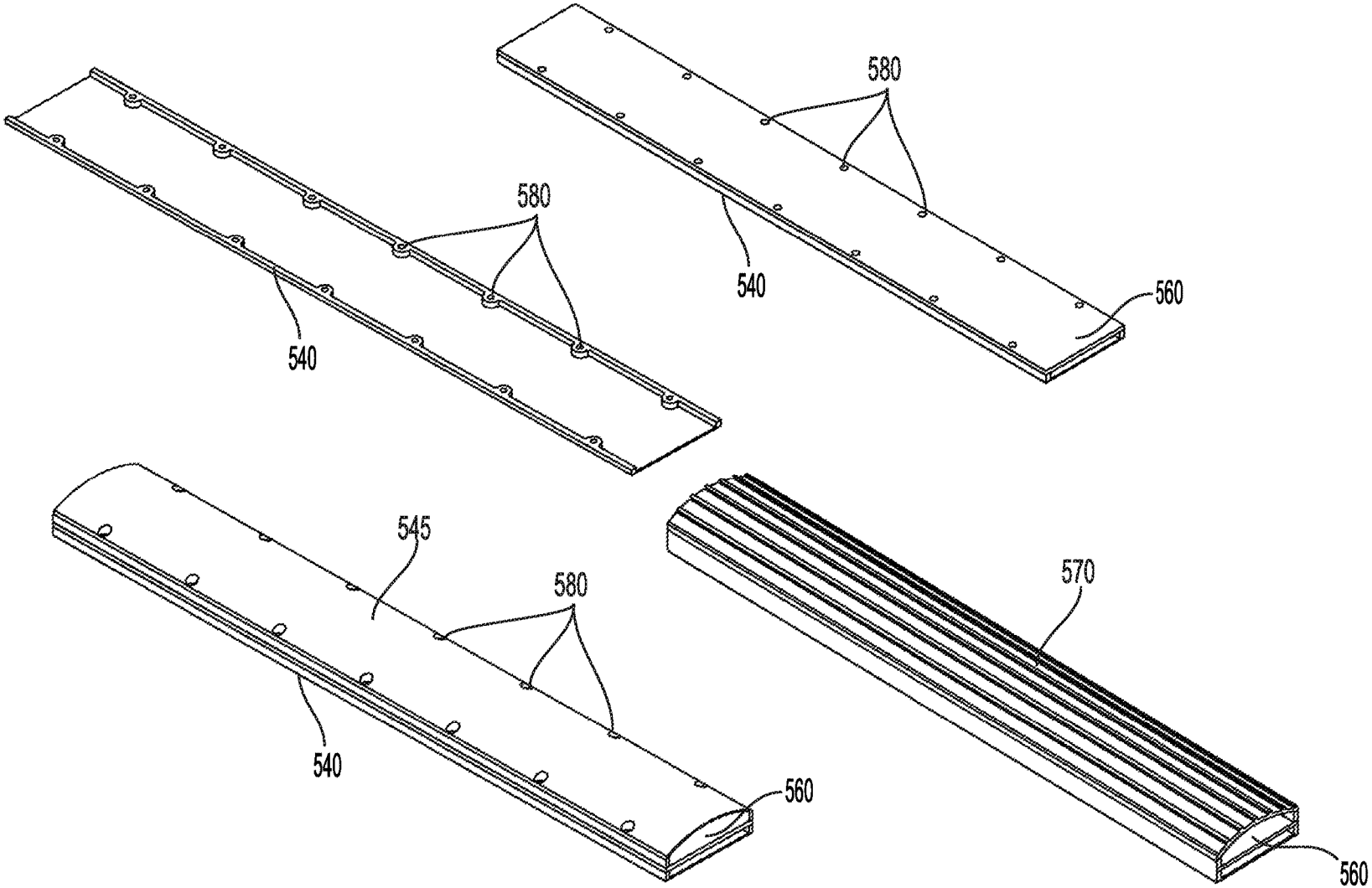
FIG. 5 is a schematic diagram illustrating a construction of a component module, in accordance with various aspects of the subject technology.

FIG. 5 is a schematic diagram illustrating a construction of a component module, in accordance with various aspects of the subject technology. FIG. 5 shows the component module as including a housing made of a chassis portion 540 and a cover portion 545. The chassis portion 540 and/or the cover portion 545 may be made of metal and/or alloy such as aluminum or steel. The housing may surround one or more components to be used on the downhole tool. Some components may include electronics that are mounted to a circuit board 560 (e.g., a PCB). The circuit board 560 may be mounted to the chassis portion 540 of the housing and covered by the covered portion 545 of the housing. Although there are several different methods of securing the circuit board 560 between the chassis portion 540 and the covered portion 545 of the housing, FIG. 5 illustrates the use of retention screws through screw holes 580 in the circuit board 560, the chassis portion 540, and the covered portion 545.

One or more layers may form a sleeve 570 that surrounds at least a portion of the metal housing. The one or more layers may be made of one or more elastomer materials. The sleeve 570 may prevent the portion of the metal housing that is covered from coming in contact with the pocket of the downhole tool. The sleeve 570 may provide the metal housing with shock isolation, superior vibration transmissibility response, and/or room for thermal expansion.

In FIG. 5, the sleeve 570 is shown to include raised surfaces configured to optimize the shock isolation and/or vibration transmissibility characteristics of the sleeve 570. The raised surfaces may also be configured to achieve a better fit for the component module in the pocket of the downhole tool or aid the insertion/removal of the metal housing with respect to the pocket. In FIG. 5, the raised surfaces are oriented to form a series of parallel ribs running the length of the top surface of the cover portion 545 of the module housing. However, in other embodiments, the raised surfaces may additionally or alternatively be arranged as intersecting ribs, vertical ribs, horizontal ribs, nodes, nubs, bumps, or other configurations along the top, bottom, or sides of the metal housing. According to some implementations, the raised portions may be configured to fit the metal housing into different pocket sizes, downhole tool sizes with different sized pressure sleeve, and/or pipe sizes.

The electronic components housed in the component module may, in some cases generate heat which can adversely affect performance, especially in an already hot downhole environment. According to some embodiments, in order to improve the heat transmissibility characteristics of the component module, portions of the circuit board and/or the electronic components may be positioned in contact or near contact with the chassis. Additionally or alternatively, the elastomer sleeve may include one or more windows or openings where a heat transfer material such as copper mesh may be placed in contact with the metal housing of the component module and the outer tube (e.g., a pressure sleeve) or the pocket of the downhole tool. Accordingly, the heat transfer material may allow heat from the metal housing to be dissipated through the copper mesh and the outer tube or pocket of the downhole tool. The window and the heat transfer material may be placed in proximity to any known heat generating electronic components. An alternative embodiment utilizes thermally conductive elastomer material for the elastomer sleeve 570.

In another aspect, a fiberglass or low friction material sleeve may be used to surround the high performance elastomer of the component module and/or the recessed portion of the downhole tool to reduce friction between the high performance elastomer and an inner surface of the outer tube (e.g., the pressure sleeve) and/or the pocket of the downhole tool. In this example, the fiberglass sleeve may also have openings aligned with the openings of the elastomer to facilitate heat transfer using the copper mesh or any other compliant thermally conductive material.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logic blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purpose computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrative embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1. An electronics module for a downhole tool comprising a metal housing comprising a chassis portion and a cover portion, the metal housing configured to fit within a pocket of a downhole tool; a circuit board positionable between the chassis portion and the cover portion of the metal housing, the circuit board having a top side and a bottom side and one or more electronic components mounted on at least one of the top and bottom sides; and an elastomer sleeve surrounding at least one portion of the metal housing and preventing the at least one portion of the metal housing from contact with the pocket of the downhole tool.

Statement 2. The electronics module of statement 1, wherein the electronics module is held in the pocket of the downhole tool using one or more end tabs.

Statement 3. The electronics module of statement 1 and 2, wherein the circuit board is positioned within the metal housing using one or more retention screws.

Statement 4. The electronics module of statement 1 through 3, wherein the metal housing is aluminum.

Statement 5. The electronics module of statement 1 through 4, wherein the elastomer sleeve comprises a layer formed using a high pressure injection molding process.

Statement 6. The electronics module of statement 1 through 5, wherein the elastomer sleeve comprises a set of raised surfaces.

Statement 7. The electronics module of statement 1 through 6, further comprising a composite sleeve surrounding at least a portion of the elastomer sleeve.

Statement 8. The electronics module of statement 1 through 7, further comprising a pressure sleeve surrounding at least a portion of the elastomer sleeve.

Statement 9. The electronics module of statement 1 through 8, wherein the elastomer sleeve comprises one or more openings, the electronics module further comprising a heat conductive material positioned within the one or more openings configured to conduct heat away from the metal housing.

Statement 10. The electronics module of statement 1 through 9, wherein the heat conductive material is copper mesh.

Statement 11. The electronics module of statement 1 through 10, wherein the heat conductive material is in contact with the metal housing and at least one of the pocket of the downhole tool or an outer tubing covering at least a portion of the elastomer sleeve.

Statement 12. The electronics module of statement 1 through 11, wherein the one or more openings are positioned in proximity to heat generating electronic components of the one or more electronic components mounted on the circuit board.

Statement 13. A component module for a downhole tool comprising a platform for components for use in the downhole tool; an enclosure covering the platform for components, wherein the enclosure is configured to fit within a pocket of the downhole tool; and an elastomer layer surrounding at least one portion of the enclosure and preventing the at least one portion of the enclosure from touching the pocket of the downhole tool.

Statement 14. The component module of statement 13, wherein the enclosure is aluminum and comprises a chassis portion and a cover portion.

Statement 15. The component module of statement 13 and 14, wherein the platform for components comprises at least one of a circuit board for electronic components, a sensor compartment, or a battery compartment.

Statement 16. A downhole tool comprising a recessed portion comprising at least one pocket; a component module; an unrecessed portion comprising a shoulder; and a pressure sleeve covering the recessed portion of the downhole tool and adjacent to the shoulder of the unrecessed portion. The component module comprises a platform for components, an enclosure covering the platform for components, wherein the enclosure is configured to fit within the at least one pocket of the recessed portion, and an elastomer layer surrounding at least one portion of the enclosure.

Statement 17. The downhole tool of statement 16, wherein the platform for components is configured to carry at least one of electronics, a sensor, a battery, a transmitter, or a receiver.

Statement 18. The downhole tool of statement 16 and 17, wherein the elastomer layer forms a sleeve covering the at least one portion of the enclosure.

Statement 19. The downhole tool of statement 16 through 18, wherein the elastomer layer comprises a set of raised surfaces.

Statement 20. The downhole tool of statement 16 through 19, further comprising a composite sleeve covering at least a portion of the recessed portion of the downhole tool.

What is claimed is:

1. An electronics module for a downhole tool comprising:

a metal housing comprising a chassis portion and a cover portion, the metal housing configured to fit within a pocket of the downhole tool, wherein the pocket is disposed in an outer surface of a recessed portion of the downhole tool;

a circuit board positionable between the chassis portion and the cover portion of the metal housing, the circuit board having a top side and a bottom side and one or more electronic components mounted on at least one of the top and bottom sides, the circuit board being directly mounted to the metal housing; and an elastomer sleeve surrounding at least one portion of the metal housing and preventing the at least one portion of the metal housing from contact with the pocket of the downhole tool.

2. The electronics module of claim 1, wherein the electronics module is configured to be held in the pocket of the downhole tool using one or more end tabs.

3. The electronics module of claim 1, wherein the circuit board is positioned within the metal housing using one or more retention screws.

4. The electronics module of claim 1, wherein the metal housing is aluminum.

5. The electronics module of claim 1, wherein the elastomer sleeve comprises a layer formed using a high pressure injection molding process.

6. The electronics module of claim 1, wherein the elastomer sleeve comprises a set of raised surfaces.

7. The electronics module of claim 1, further comprising a composite sleeve surrounding at least a portion of the elastomer sleeve.

8. The electronics module of claim 1, further comprising a pressure sleeve surrounding at least a portion of the elastomer sleeve.

9. The electronics module of claim 1, wherein the elastomer sleeve comprises one or more openings, the electronics module further comprising:

a heat conductive material positioned within the one or more openings configured to conduct heat away from the metal housing.

10. The electronics module of claim 9, wherein the heat conductive material is copper mesh.

11. The electronics module of claim 9, wherein the heat conductive material is in contact with the metal housing and at least one of the pocket of the downhole tool or an outer tubing covering at least a portion of the elastomer sleeve.

12. The electronics module of claim 9, wherein the one or more openings are positioned in proximity to heat generating electronic components of the one or more electronic components mounted on the circuit board.

13. A component module for a downhole tool comprising:

a platform for components for use in the downhole tool;

an enclosure covering the platform for components, wherein the components include a circuit board for electronic components, wherein the circuit board is directly mounted to the enclosure; wherein the enclosure is configured to fit within a pocket of the downhole tool, wherein the pocket is disposed in an outer surface of a recessed portion of the downhole tool; and an elastomer layer surrounding at least one portion of the enclosure and preventing the at least one portion of the enclosure from touching the pocket of the downhole tool.

14. The component module of claim 13, wherein the enclosure is aluminum and comprises a chassis portion and a cover portion.

15. The component module of claim 13, wherein the platform for components comprises at least one of a sensor compartment, or a battery compartment.

16. A downhole tool comprising:

a recessed portion comprising at least one pocket;

a component module comprising:

a platform for components, the components including a circuit board for electronic components, an enclosure covering the platform for components, wherein the circuit board is directly mounted to the metal housing, wherein the enclosure is configured to fit within the at least one pocket disposed in an outer surface of the recessed portion, and an elastomer layer surrounding at least one portion of the enclosure;

an unrecessed portion comprising a shoulder; and a pressure sleeve covering the recessed portion of the downhole tool and adjacent to the shoulder of the unrecessed portion.

17. The downhole tool of claim 16, wherein the platform for components is configured to carry at least one of a sensor, a battery, a transmitter, or a receiver.

18. The downhole tool of claim 16, wherein the elastomer layer forms a sleeve covering the at least one portion of the enclosure.

19. The downhole tool of claim 16, wherein the elastomer layer comprises a set of raised surfaces.

20. The downhole tool of claim 16, further comprising a composite sleeve covering at least a portion of the recessed portion of the downhole tool.

* * * * *